United States Patent [19]

Brennecke et al.

[11] 4,042,971

[45] Aug. 16, 1977

[54] ELECTROSTATIC CHARGE NEUTRALIZATION

[76] Inventors: Hermann Brennecke, Schwambstrasse 37, D-6100 Darmstadt; Horst Liere, Sandweg, D-6116 Eppertshausen, both of Germany

[21] Appl. No.: 684,555

[22] Filed: May 10, 1976

Related U.S. Application Data

[63] Continuation-in-part of Ser. No. 511,307, Sept. 30, 1974, abandoned.

[51] Int. Cl.[2] ..... H01T 19/00

[52] U.S. Cl. ..... 361/213; 361/227

[58] Field of Search ..... 317/2 F, 3, 4, 262 A; 361/213, 227

[56] References Cited

U.S. PATENT DOCUMENTS

| | | | |
|---|---|---|---|
| 2,221,338 | 11/1940 | Wintermute | 317/3 |
| 3,369,152 | 2/1968 | Spengler | 317/2 F |
| 3,680,779 | 8/1972 | Reilly | 317/3 |
| 3,968,405 | 7/1976 | Testone | 317/4 |
| Re. 28,394 | 4/1975 | Point | 317/3 |

FOREIGN PATENT DOCUMENTS

| | | | |
|---|---|---|---|
| 2,332,128 | 1/1975 | Germany | 317/3 |

*Primary Examiner*—Gerald Goldberg
*Attorney, Agent, or Firm*—Spencer & Kaye

[57] ABSTRACT

In an electrostatic coating system in which material is sprayed onto a workpiece under the influence of an electrostatic field, any electrostatic charge supplied to the workpiece is removed by a discharging device maintained out of contact with the workpiece and disposed so that its effective range is outside the material spray region.

2 Claims, 4 Drawing Figures

ELECTROSTATIC CHARGE NEUTRALIZATION

CROSS-REFERENCE TO RELATED APPLICATION

This application is a continuation-in-part of copending application Ser. No. 511,307, filed Sept. 30, 1974 now abandoned.

BACKGROUND OF THE INVENTION

The present invention relates to a method and apparatus for electrically discharging conductive workpieces which pass through electrostatic lacquering or coating installations and are lacquered or coated by spray guns or the like.

The invention will be described with reference to spray coating since this constitutes the main field of application for the present invention; the invention can, however, also be used for electrostatic lacquering systems.

During electrostatic coating, forces created in the electrostatic high voltage field are utilized for transporting the powder to be applied to the workpiece. Between the electrically negative spray gun and the grounded workpiece there exists a voltage of about 100 to 150 kV and thus a field of high electrical intensity. The powder particles disposed within the electrical field are negatively charged and are thus moved by the electrical field forces along the lines of force of the field toward the workpiece. In order for the driving potential difference between the electrostatically charged powder particles and the workpieces to remain effective, it is important for the workpieces to be well grounded. Furthermore, grounding of the workpiece prevents it from being electrically charged by the coating process and thus endangering the safety of the operating personnel.

If high electrical charges exist on the workpiece, spark discharges will occur when the workpiece comes close to grounded objects, possibly resulting in explosive combustion of the mixture of powder and air in the spray chambers. It is therefore necessary to assure sufficient grounding of the workpieces under all circumstances.

It is known to monitor the ground connection which has been provided by effecting a direct measurement of the resistance between the workpiece and ground. This requires contact with the workpiece, however, in order to form an ohmic measuring circuit. In many cases this cannot be achieved in practice due to the shape of the workpiece involved. Furthermore, substantial measuring errors result if the point of contact — be it at the workpiece or at the measuring sensor — is soiled.

Test have been performed in which a workpiece was conducted through a high voltage field before entering the coating system, was there charged electrically and then, after a certain period of time, a measurement was made to determine how much charge was retained by the workpiece.

Thus in the known processes the grounding resistance is measured directly. If this resistance is still too high it is necessary to remove the workpieces involved or to interrupt the process until a satisfactory ground connection has been produced.

SUMMARY OF THE INVENTION

In view of this, it is an object of the present invention to assure electrical discharging of essentially conductive workpieces independently of their shape so that interruptions in the process or the necessity for separating insufficiently grounded workpieces is avoided. In this connection, a conductive workpiece is one in which electrical charges can move freely, i.e., a workpiece of other than insulating material.

This is accomplished, according to the present invention, by passing the workpieces through a discharging apparatus, at least during the coating process, which apparatus operates without contact and is arranged near the path of the workpieces in such a manner that the field of radiation of the apparatus lies outside of the spray range of the spray pistol while being in charge-conducting communication with at least one point on the workpiece.

The present invention is initially based on the realization that it is not sufficient, for economical operation, to detect electrically charged workpieces and to sort them out, but rather that it is necessary to free these workpieces from such charges. This is effected, according to the present invention, by discharging devices which operate without contact, for example by peak ionizers, alternating voltage ionizers or radioactive radiators. Their effect consists in that they partially ionize the air molecules in their radiation field and thus increase the electrical conductivity of the air. As a result of the discharging operation the workpiece is continuously discharged so as to be maintained substantially at ground potential during the coating operation.

It is particularly advisable for the discharging device to be designed as an alternating voltage ionizer which operates at a voltage of the order of magnitude of about 5 to 15 kV.

An apparatus for practicing the above-described method which has been found to be particularly advantageous is an alternating voltage ionizer containing a plastic rail having a longitudinal groove in which are disposed a series of metallic tips, particularly tungsten tips, oriented to extend perpendicularly away from the bottom of the groove. The base of the tips is connected to ground potential and an electrical conductor is disposed to both sides of the groove, an alternating voltage with a peak value of from 5 to 15 kV being present between the two conductors.

DESCRIPTION OF THE PREFERRED EMBODIMENTS

Figure 1:
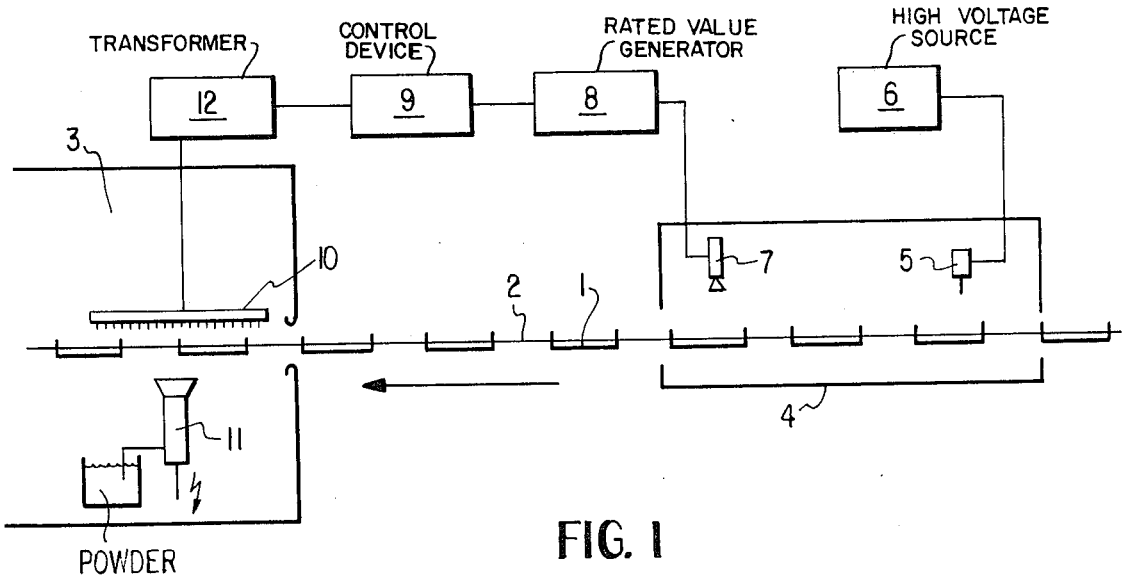
FIG. 1 shows a monitoring device with a spray gun and an ionizer disposed on one side.
Figure 2:
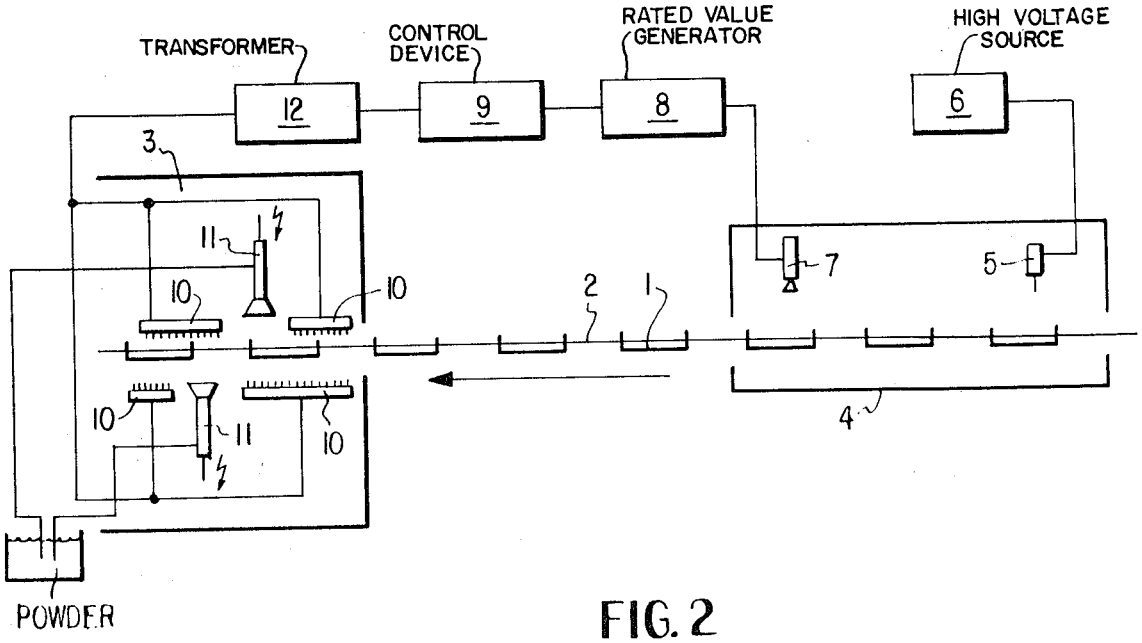
FIG. 2 shows a monitoring device with the spray gun and the ionizer disposed on both sides thereof.

The arrangements shown in FIGS. 1 and 2 operate on the same principle so that both figures are described together. As shown in FIGS. 1 and 2, workpieces 1 to be coated are fastened to a rotating conveyor belt 2. Before they enter the coating chamber 3, it is determined at a preceding testing station 4 whether the workpieces are sufficiently grounded. This is accomplished by means of a high voltage electrode 5 which is connected to a high voltage source 6. The electrical field produced between the high voltage electrode 5 and each succeeding workpiece 1 causes the workpiece 1 to be electrically charged as it passes by the high voltage electrode 5.

A measuring sensor 7 is disposed at a suitable distance from the high voltage electrode 5. This measuring sensor is preferably a field intensity measuring device which registers for every workpiece the extent to which the electrical charge produced by the high voltage electrode 5 has been dissipated from the workpiece after a given time. The measurement of the residual charge still present at each successive workpiece is transmitted by the measuring sensor 7 to a rated value generator 8. If the residual charge exceeds a previously determined and set rated value, the ground connection of the respective workpiece is insufficient and a control device 9 which is coupled with the rated value generator causes a discharging device 10 to be switched on.

The discharging device 10 is preferably an alternating voltage ionizer and is connected to a high voltage transformer 12 having a peak output voltage of 8 to 12 kV. Air is ionized in the radiation region of the ionizer so that its electrical conductivity is increased to such an extent that a workpiece — as soon as it enters the radiation range — can be gradually discharged. The extent of the discharging depends of course on the intensity of the high voltage ionizer, i.e., on the intensity of the ionization generated by it. It has to be sufficiently powerful that the residual electrical energy on the workpiece is too low to produce sparks capable of triggering an explosion, i.e., below about 5 milli Joule.

With appropriate dimensions and feeding of the ionizer it can be assured that the workpieces will be discharged in any case except for a residual charge of harmless magnitude. The danger of combustion of the mixture of powder and air by spark discharges is thus completely eliminated. There also results the advantage that the potential difference between the spray gun 11 which is also connected to a high voltage source (for example the high voltage source 6) and the workpiece remains almost completely unchanged, i.e., the electrical field remains sufficiently strong to bring the coating powder up to the workpiece. This results in a uniform layer thickness over the entire workpiece and only relatively small powder losses.

Care must of course be taken that the spray range or pattern of the spray gun 11 is not influenced by the discharging device. Otherwise the negatively charged powder particles would be electrically discharged and would no longer be brought to the workpiece with the desired attraction force. It is therefore necessary to dispose the discharging device at a sufficient distance to the side of the spray gun 11. In this case the so-called field line envelope is not interfered with and the workpiece is thus simultaneously coated on its backside, even though to a lesser extent. If this is not necessary, it is possible to arrange the discharging device opposite the spray gun but to the rear of the workpiece.

FIGS. 1 and 2 differ from one another only in that in the system of FIG. 1 the workpieces are coated only on one side and in the system of FIG. 2 on both sides. Accordingly, spray guns and discharging devices are arranged on both sides of the workpiece in the arrangement of FIG. 2.

Figure 3:
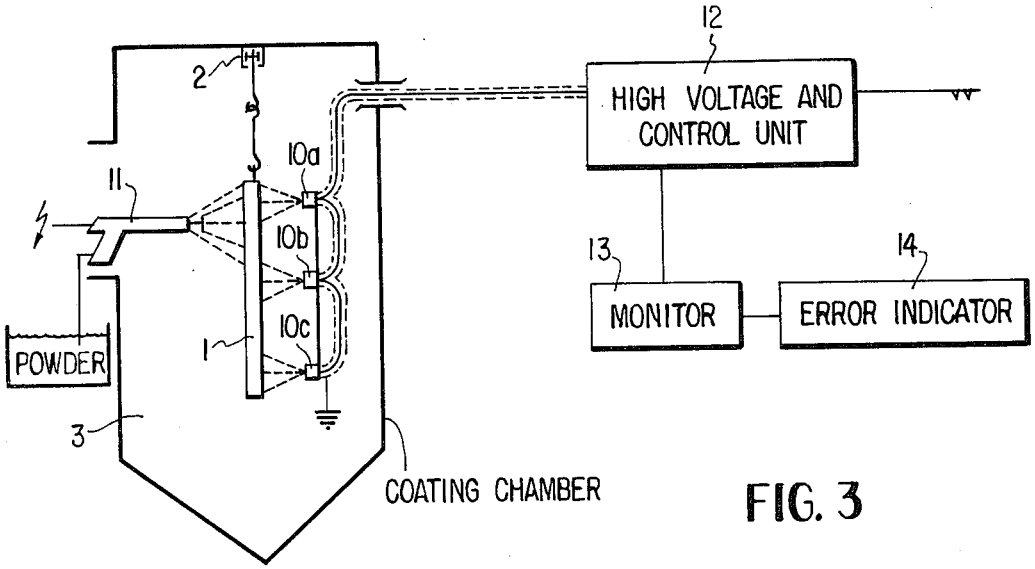
FIG. 3 shows an embodiment of the invention constituted by an arrangement of the type shown in FIG. 1 but without ground monitoring.

The process carried out in the arrangement shown in FIG. 3 goes a step further since in it no monitoring for sufficient grounding of the workpieces is effected. The use of a testing station 4 with a high voltage electrode 5 and a measuring sensor 7 is thus made unnecessary.

The design of the discharging device of FIG. 3 is intentionally based on the fact that after several cycles of travel of the conveyor belt the hangers for the workpieces 1 on the conveyor belt 2 are so heavily coated with powder that the resistance of the current flow path between the workpiece and the conveyor belt is practically infinite. In order to dependably assure sufficient discharging of the workpiece, three series-connected alternating voltage ionizers **10*a*, 10*b* and 10*c* are provided. These ionizers are disposed to ionize air molecules in a region which is outside of the spray pattern of the gun 11 and which at the same time is in conductive association with at least part of the workpiece 1 while it is being coated so that any electrostatic charges delivered to the workpiece will drain off via the region of ionized air molecules. Thus, the workpiece is effectively grounded, and maintained substantially at ground potential, continuously during a coating operation, without reliance on a physical conductive connection between the workpiece and ground. The ionizers are connected to a high voltage transformer 12, via a high voltage cable, and the output end of the transformer is monitored and/or regulated by a monitoring and regulating unit 13. Great changes in the output energy which indicate possible faults are detected by an error indicator 14** and are signalled optically or acoustically. These faults may be parting of a cable, ground contact or voltage loss of the ionizer, for example.

The system illustrated in FIG. 3 has the advantage that the transfer resistance between workpiece and conveyor belt, i.e., between workpiece and ground, is no longer of any significance since the ionizers assure that the residual charge remaining on the workpieces is too low to produce sparks capable of triggering an explosion. The cleaning of the hangers for the workpieces, which previously was required at certain intervals in order to assure a low transfer resistance, can be eliminated entirely. In existing larger coating systems this alone results in monthly savings of more than $30,000.

Figure 4:
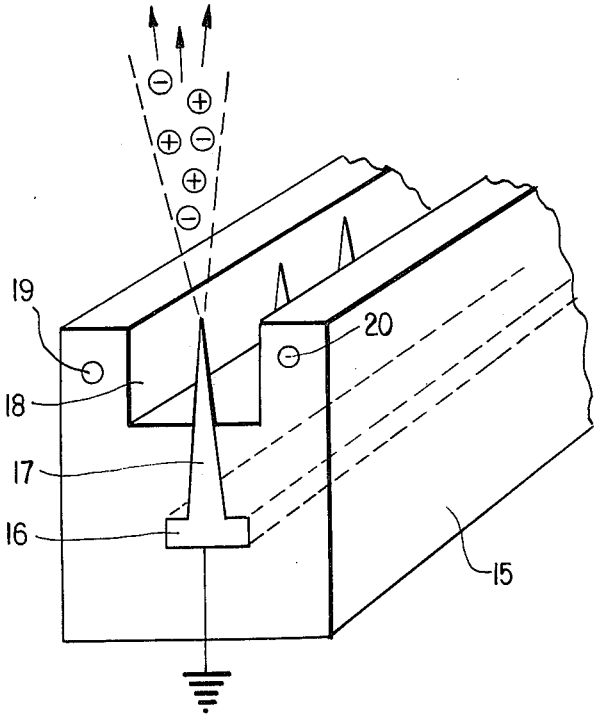
FIG. 4 shows the structure of an alternating voltage ionizer used in the system of FIG. 3.

Finally, FIG. 4 shows one preferred embodiment of the structure of one alternating voltage ionizer. It includes a plastic rail 15 into which a metal rod 16 is molded. Rod 16 is provided on its top side with a plurality of tips 17. The tips 17 protrude to the outside at a longitudinal groove 18 in the plastic rail. On both sides of this groove 18 electrical conductors 19 and 20 are arranged to carry potentials which establish between them an alternating voltage of about 8 to 12 kV. The metal rod 16 is grounded. The plastic rail is made, for example, of a thermosetting epoxy resin. Its length and the voltage between the conductors 19 and 20 are adapted to the size of the workpieces to assure that their residual energy is below 5 milli Joule. For example, the cross-section of the rail is about 2 cm $\times$ 2 cm, and that of the groove 18 is about 0.5 cm $\times$ 0.5 cm.

The high voltage field between conductors 19 and 20 causes electrons to be emitted at tips 17 which electrons ionize the air molecules generally in the radiation direction.

The ionizers are arranged at a distance of approximately 5 to 25 cm from the workpiece so that the ionization can develop its optimum effectiveness. The intensity of the ionization is controlled, by the monitoring and regulating unit 13 shown in FIG. 3, by controlling the voltage between conductors 19 and 20.

It will be understood that the above description of the present invention is susceptible to various modifications, changes and adaptations, and the same are intended to be comprehended within the meaning and range of equivalents of the appended claims.

What is claimed is:

1. In a process for applying, to a conductive workpiece arranged to move through a coating installation, a layer of material by spray means providing a spray of such material which is applied to the workpiece with the aid of an electrostatic field, the improvement comprising conducting electrostatic charges on the workpiece to ground, at least while such layer is being applied to the workpiece, by ionizing the air adjacent a portion of the workpiece by means of a discharging device maintained out of contact with the workpiece and disposed near the path of travel of the workpiece through the installation so that the effective range of the discharging device communicates with the workpiece while being outside of the spray range of the spray means.

2. A method as defined in claim 1 wherein the discharging device is an alternating voltage ionizer operating at a voltage of the order of magnitude of about 5–15 kV.

* * * * *